US005632119A

United States Patent [19]

Bruno

[11] Patent Number: 5,632,119

[45] **Date of Patent: *May 27, 1997**

[54] SLIDING DOOR ARRANGEMENT FOR A CONTAINMENT SPACE

[75] Inventor: Eduardo V. Bruno, Alsina 474, (1642) San Isidro, Buenos Aires, Argentina

[73] Assignees: Eduardo V. Bruno; Jorge Ricardo Lepretre, both of Buenos Aires, Argentina

[ * ] Notice: The term of this patent shall not extend beyond the expiration date of Pat. No. 5,630,294.

[21] Appl. No.: 479,206

[22] Filed: Jun. 7, 1995

Related U.S. Application Data

[63] Continuation-in-part of Ser. No. 205,490, Mar. 4, 1994.

[30] Foreign Application Priority Data

Mar. 5, 1993 [AR] Argentina ..... 324.431

[51] Int. Cl.[6] ..... E05D 15/10

[52] U.S. Cl. ..... 49/209; 49/410

[58] Field of Search ..... 49/208, 209, 409, 49/410, 411

[56] References Cited

U.S. PATENT DOCUMENTS

| | | | |
|---|---|---|---|
| 2,672,656 | 3/1954 | Lorenz . | |
| 2,842,810 | 7/1958 | Gangl . | |
| 3,334,442 | 8/1967 | Boettcher . | |
| 3,611,637 | 10/1971 | Saino . | |
| 4,114,317 | 9/1978 | Crawley . | |
| 4,575,966 | 3/1986 | Gerritsen . | |
| 4,624,074 | 11/1986 | Shuttleworth | 49/130 X |
| 4,716,693 | 1/1988 | Webster . | |
| 5,076,018 | 12/1991 | Gianfranco . | |
| 5,280,686 | 1/1994 | Davies . | |
| 5,301,468 | 4/1994 | Kamezaki . | |

*Primary Examiner*—Kenneth J. Dorner
*Assistant Examiner*—Jerry Redman
*Attorney, Agent, or Firm*—Lowe, Price, LeBlanc & Becker

[57] ABSTRACT

A vehicle door arrangement suitable for closing an opening in a container or containment structure provides for at least one door to be slidably guided by a single rail provided in the vehicle side near the top of the door. Guidance to the door between a closing position and an open position is provided by an arm located at the top of the door and carrying a wheel and a guide lug which are respectively supported and guided by the rail. A mechanism including a levered shaft is provided at the side of the opening near the bottom of the door and is operable to engage with the door thereat to hold it in a closed position relative to the opening.

7 Claims, 2 Drawing Sheets

SLIDING DOOR ARRANGEMENT FOR A CONTAINMENT SPACE

This is a Continuation-in-Part of U.S. application Ser. No. 08/205,490, filed on Mar. 4, 1994.

FIELD OF THE INVENTION

This invention relates to an arrangement of one or more lateral sliding doors for closing a containment space, e.g., a warehouse, a storage shed, or even a container temporarily located at a suitable site to store objects.

BACKGROUND OF THE RELEVANT ART

Containers and containment spaces, including even trucks and towable trailers, which have shuttered doors or partitions that serve as lateral closures or dividers are known and are used currently. Although they are in wide use, these doors or partitions entail a series of disadvantages. They are noisy and they have a large number of mobile pieces that are difficult to repair. This implies expensive maintenance and high replacement cost. They also often have side rails that are very vulnerable to impacts by forklifts. As a result, the doors or partitions are jammed or they have to be forced so that they will run along the rails.

It is a principal objective of this invention to solve the above-mentioned problems and to provide an easily operated side door or movable partition with low maintenance cost.

SUMMARY OF THE INVENTION

The principal object of this invention is to provide an arrangement of one or more sliding side doors for closure of containers or containment spaces, such as warehouses, storage rooms, and even mobile containment means like trucks and trailers, comprising at least one door, which along its upper edge has at least two means allowing the door to be guided and to slide along a single rail, the rail being attached to the upper part of a correspondingly sized opening through which access is provided to the interior of the container or containment space, means being provided for closing the door against the opening for closure thereof.

The single rail is used by all doors arranged at one and the same side since each door, when in its respective closed position, rests against a posterior part of the rail, leaving a free space for the movement of a second door in front of it. The entire arrangement, therefore, is simple, easy to operate, and compact whether in an open state or closed.

In another aspect of this invention, one or more movable partitions may be provided to be movably supported, guided and to slide along a single rail between two compartments definable by the partitions(s).

BRIEF DESCRIPTION OF THE DRAWING

The invention will be better understood with respect to the attached drawings, wherein.

DETAILED DESCRIPTION OF THE PREFERRED EMBODIMENTS

Figure 1:
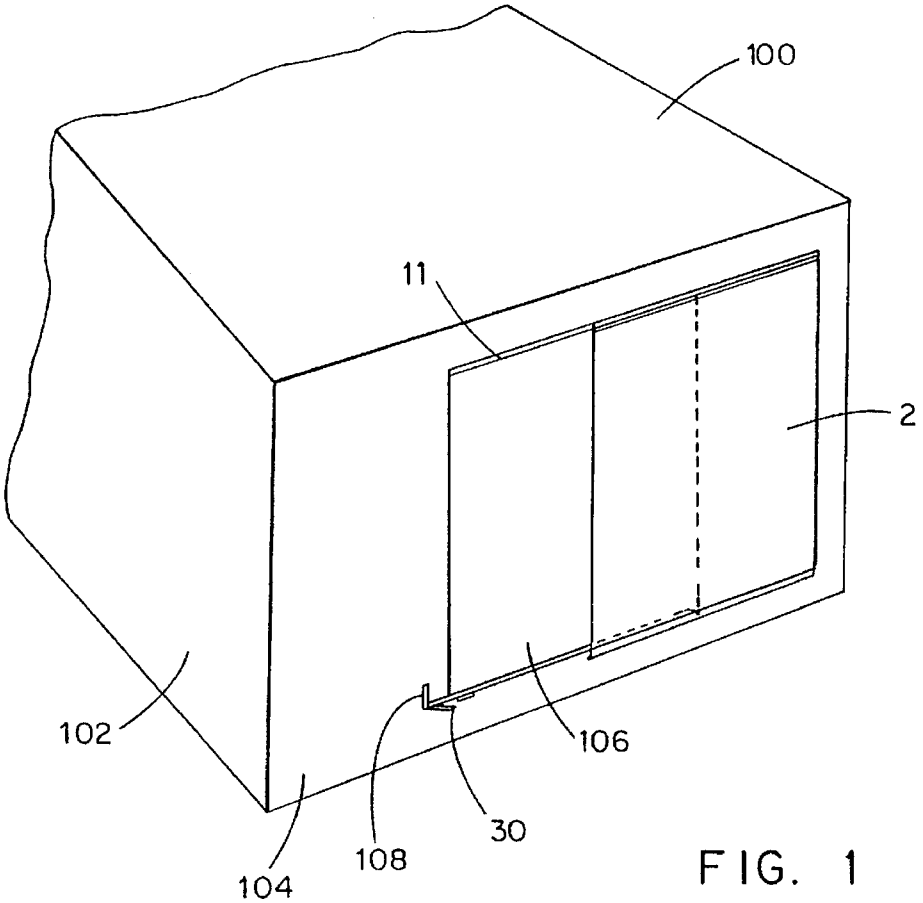
FIG. 1 is a schematic perspective view of an exemplary container or containment room fitted with a single door according to a preferred embodiment of this invention.

As best seen in FIG. 1, in a preferred embodiment of this invention a container or containment space such as a storage room 100 with a side wall 102 has a front wall 104 in which is provided a rectangular opening 106.

Along the upper horizontal edge of opening 106 is fitted a horizontal guide 11, details of which are described below, which supports door 2 (or also a second door if one is provided in the arrangement). As shown in FIG. 1, a slot 108 may be provided at a suitable location in wall 106 to accommodate a closing lever 30 operable as described below to firmly close door 2 to close off opening 106 when desired.

As will be appreciated, if opening 106 is long in a horizontal direction it may be desirable to provide two cooperating doors 1 and 2 which can be operated independently as described below.

Figure 2:
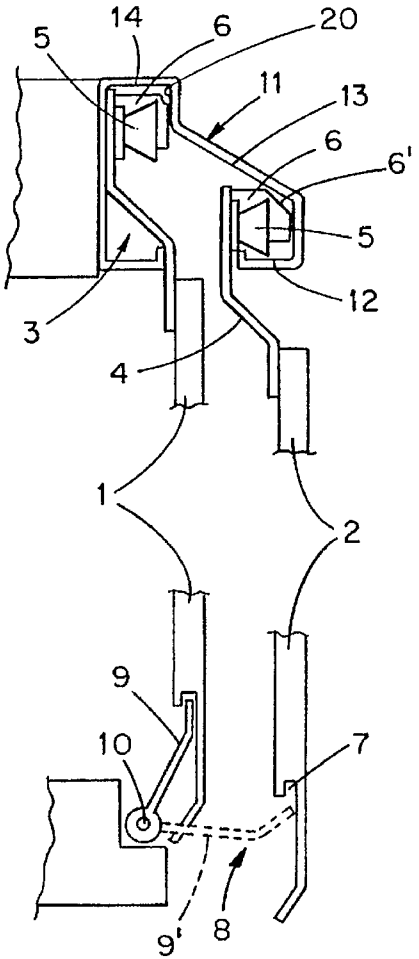
FIG. 2 schematically and in partial-sectional view illustrates the arrangement according to a preferred embodiment of the invention.
Figure 3:
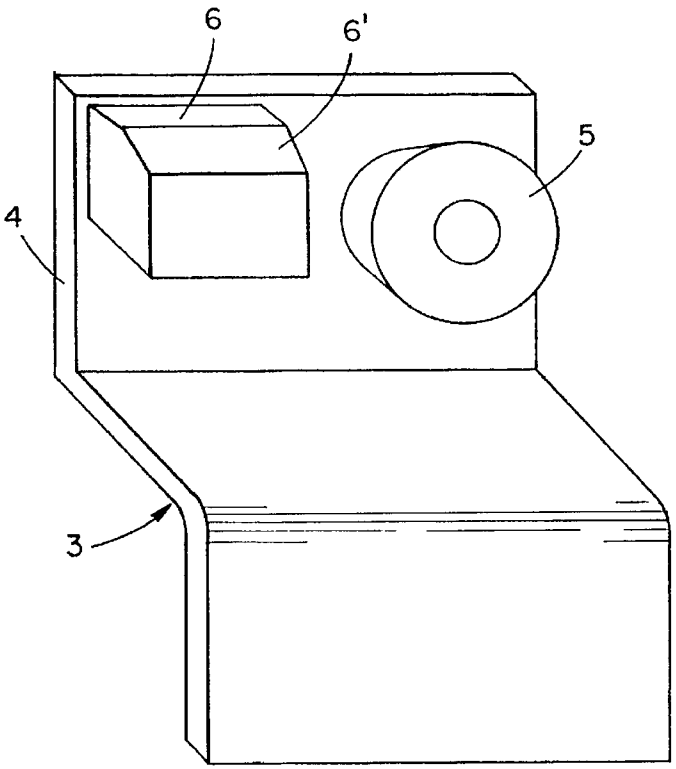
FIG. 3 shows means for allowing the door to be guided and to slide relative to the vehicle body.

FIG. 2 shows a first door 1 in its closed position and a second door 2 in its sliding position. On their upper edges, doors 1 and 2 both have at least one means for guidance and sliding 3, consisting of a rigid plate 4, suitably bent and attached to the door, for example by means of welding at one of its ends, and being provided at its other end with a wheel 5 and a guide lug 6, as best seen in FIG. 3.

Figure 4:
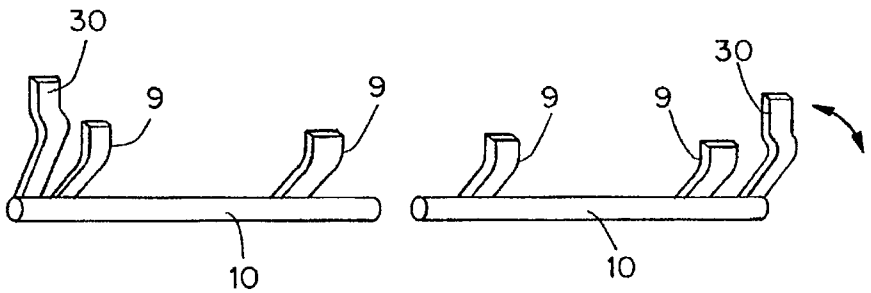
FIG. 4 is a frontal perspective view of door locking levers suitable for use with two doors cooperating to close a relatively large opening.

On their lower edges, doors 1 and 2 each have a groove 7 for the introduction of closing means 8, consisting of at least one but, preferably two, L-shaped arms mounted on a shaft 10 arranged along the vehicle side. The arms 9 are integral with a corresponding shaft 10 which at one of its ends is secured to a closing lever 30, as best seen in FIG. 4.

When in operation, door 2 is suspended from a single rail 11 that has a groove 12, along which moves wheel 5, a sliding surface 13 for guiding guide lugs 6, and an upper portion 14 for accommodating guide lug 6 in the closed door position. If a second door 1 is provided, it too is supported, guided by, and slidable along the same single rail 11.

Door 2 moves along rail 11 by means of wheel 5 which runs along groove 12. Once door 2 is located in the position in which it will be closed, the closing lever 30 may be operated manually and this will cause shaft 10 and arms 9 to turn. The arms 9 engage door 2 via its groove 7, and are operable to raise door 2 somewhat, as best seen in FIG. 2.

As best seen in FIG. 1, when the door is in its open position the arm 9 is rotated to a position indicated by broken lines and numbered 9'. When the door is raised to its closed position, guide lug 6, which has an inclined edge 6' makes sliding contact with the sliding surface 13 of rail 11. This causes guide and movement means 3 to slide toward an upper closing position in which the door remains firmly closed, since its upper part continues to be held by guide lug 6 that remains secured at the upper end 14 of the rail, and the lower part remains secured by arms 9 which are fastened in the closing position by means of the closing lever. The closing lever 30 is secured to the wall 104, for example by means of a latch. When door 1 is in its closing position, sliding surface 13 of rail 11 preferably presents an upward portion 20 which cooperates with guide lugs 6 to keep them in their corresponding position.

Wheel 5 preferably has a generally conical shape and is preferably metallic. Guide lug 6 is preferably made of a tough plastics material such as, for example, Teflon™ which can be given a smooth finish.

The arrangement of the side doors, according to this invention, not only makes it possible to eliminate the previously-mentioned disadvantages, but it also allows use of larger doors. This requires the wall 104 to have an opening 106 with a very large size but without the need for a single equally large door to close it. Since such an arrangement has only two mobile parts per door, each door is easy to operate, easy to repair, and easy to maintain. The only requirement is to periodically lubricate the rollers of wheels 5 and wheel 11.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. An arrangement of a plurality of sliding side doors closing an opening in a wall of a containment means, comprising:

at least one door;

support means provided at an upper edge of the opening for supporting said at least one door, said support means comprising a single rail provided along a side of the opening along which said at least one door is guided and slides relative to the opening, said support means also comprising a wheel and a fixed guide lug both mounted to the at least one door and located during use inside the single rail; and closing means mounted to said wall and arranged at a lower side of the opening to engage a lower portion of said at least one door in a closed position thereof.

2. An arrangement of a plurality of sliding side doors closing an opening in a wall of a containment means, comprising:

at least one door;

support means provided at an upper edge of the opening for supporting at least one door, said support means comprising a single rail provided along a side of the opening along which said at least one door is guided and slides relative to the opening, said support means also comprising a rotatable wheel and a fixed guide lug both mounted to the at least one door and located during use inside the single rail; and closing means mounted to said wall and arranged at a lower side of the opening to engage a lower portion of said at least one door in a closed position thereof, wherein said rail has a sliding groove for receiving said wheel therein, a sliding surface for guiding said guide lug by making sliding contact therewith, and an upper end portion for receiving said guide lug.

3. The arrangement of sliding side doors according to claim 2, wherein:

said single rail sliding surface comprises an upper portion for guiding and accommodating said guide lug when said at least one door is put in a closed position by said closing means.

4. The arrangement of sliding side doors according to claim 3, wherein:

said closing means comprises a shaft that is provided with a closing lever and at least two L-shaped arms, wherein said arms and said closing lever are formed to be integral with said shaft.

5. The arrangement of sliding side doors according to claim 4, wherein:

said at least one door is provided with a U-shaped groove along a lower edge for receiving said arms and being raised thereby to a closed position.

6. An arrangement of a plurality of sliding side doors closing an opening in a wall of a containment means, comprising:

at least one door;

support means provided at an upper edge of the opening for supporting at least one door, said support means comprising a single rail provided along a side of the opening along which said at least one door is guided and slides relative to the opening, said support means also comprising a rotatable wheel and a fixed guide lug both mounted to the at least one door and located during use inside the single rail; and closing means mounted to said wall and arranged at a lower side of the opening to engage a lower portion of said at least one door in a closed position thereof, wherein said wheel is a conical wheel and said guide lug is located to make sliding contact with a sliding surface of the rail as said at least one door is moved to a closed position.

7. The arrangement of side doors according to claim 6, wherein:

said wheel is metallic and said guide lug is made of a tough plastics material provided with a smooth finish.

* * * * *